United States Patent [19]

Van Drie

[11] 4,253,791

[45] Mar. 3, 1981

[54] UNLOADING-TYPE CONVEYOR SYSTEM

[76] Inventor: Gerhardt Van Drie, 724 W. Pine Ave., El Segundo, Calif. 90245

[21] Appl. No.: 63,183

[22] Filed: Aug. 3, 1979

[51] Int. Cl.[3] ..... B65F 3/24

[52] U.S. Cl. ..... 414/528; 414/786; 198/728; 198/733

[58] Field of Search ..... 414/528, 786; 198/728, 198/733

[56] References Cited

U.S. PATENT DOCUMENTS

| | | | |
|---|---|---|---|
| 3,291,327 | 12/1966 | Simmons et al. | 198/728 |
| 4,068,769 | 1/1978 | Sweet et al. | 414/528 |

*Primary Examiner*—Joseph E. Valenza

*Attorney, Agent, or Firm*—Francis X. LoJacono

[57] ABSTRACT

An improved conveyor system, designed particularly for unloading bulk cargo, such as refuse, from a tractor-trailer type transporter. The conveyor system traverses the full length of the trailer cargo-box floor and includes at least a pair of endless chains arranged in parallelism, each chain being affixed to a plurality of cleat members that are affixed in a predetermined space relationship to each other, the cleats being arranged along only one-quarter of the total continuous length of the chains; and wherein the cleats are positioned along the rear half of the cargo box floor when loading refuse therein, whereby the rear half of the refuse is unloaded first, followed by the forward half of the refuse.

5 Claims, 5 Drawing Figures

FIG. 1
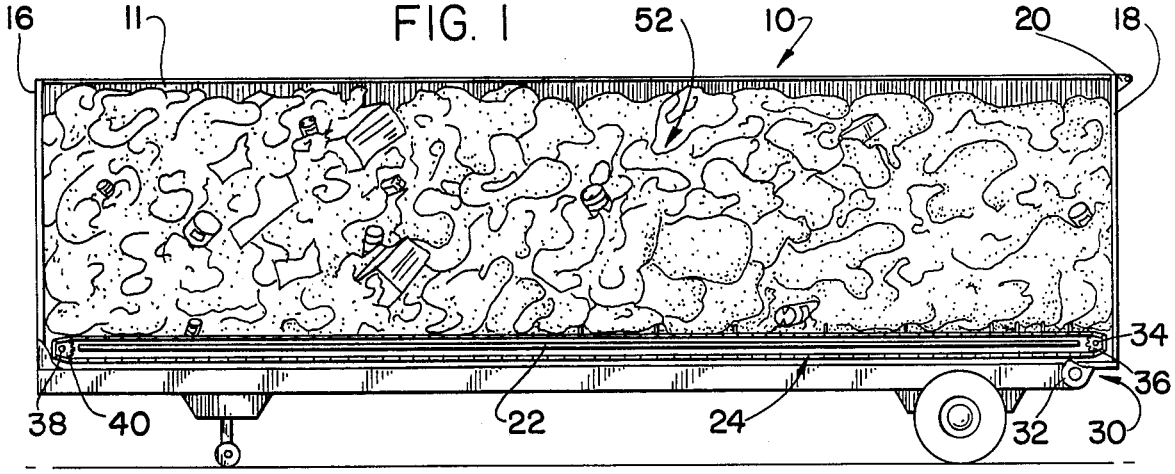
FIG. 2
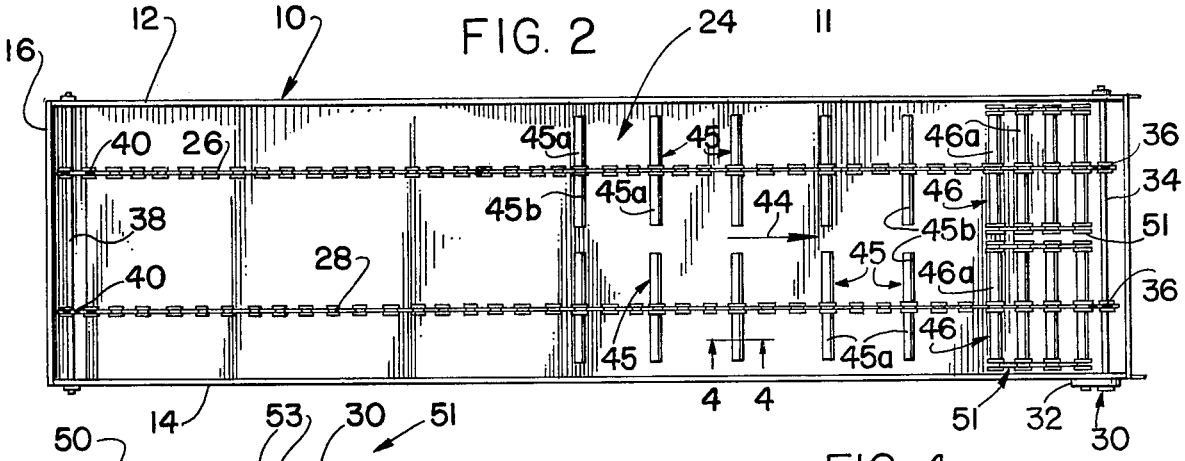
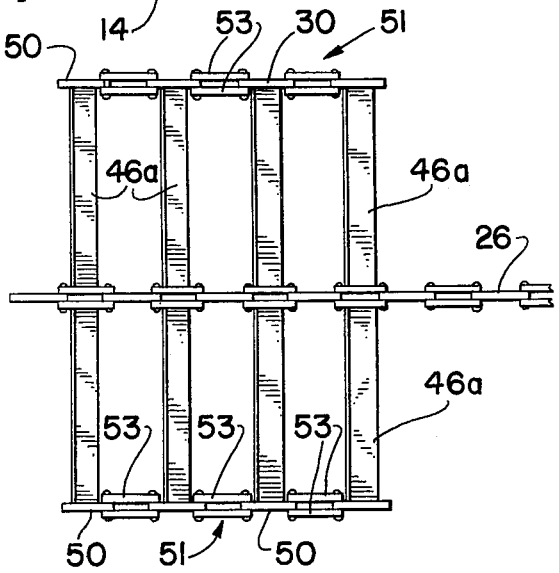
FIG. 3
FIG. 4
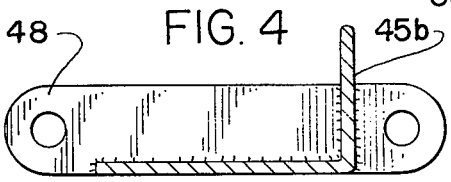
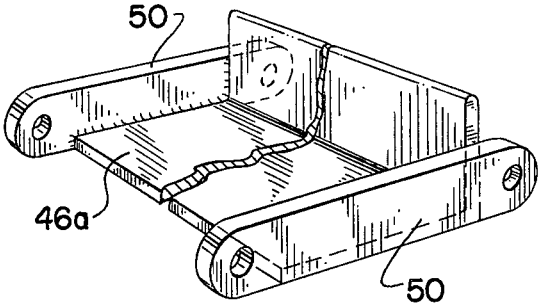
FIG. 5

UNLOADING-TYPE CONVEYOR SYSTEM

BACKGROUND OF THE INVENTION

1. Field of the Invention

The present invention relates generally to a conveyor system, and more particularly to a conveyor system for unloading a tractor-trailer cargo box designed to transport bulk refuse.

2. Description of the Prior Art

As is well known in the art, various problems and difficulties are encountered in providing a suitable means for unloading and discharging, from large trailers, the bulk refuse contained in cargo-box transporters.

There are many forms and types of cargo boxes for vehicles that are used in transporting bulk cargo, such as trash and refuse. This refuse is generally compacted within the various cargo boxes, thus leading to problems in unloading. Several methods of unloading have been attempted, but there have been numerous problems with respect to breakdown time. Due to the heavy loads and the compactness of the refuse materials, the average conveyor system employed is not structurally capable of moving the total bulk of material contained in these cargo boxes, particularly with respect to the large tractor-trailer type generally being used for long hauling.

Breakdown problems have become very serious, and designers of such vehicles are continuously working on improvements—not only in the cargo-box trailers, but also in the means for unloading them in an efficient manner, whereby the discharge of the contents is complete.

One such example of a refuse-conveyor system is disclosed in U.S. Pat. No. 4,068,769 issued to Philip J. Sweet, et al, and is well known in the industry. However, it can be seen that the conveyor system as disclosed must move the entire load of refuse within the cargo area at one time for discharging. Hence, the weight and extreme loads of a full cargo to be discharged create drastic problems.

When a conveyor system is designed to move a full load along the full length of the cargo box, the chain belt and the bars cannot withstand the constant strain under the forces generated. Thus, the load must be reduced on the overall conveyor system.

It can be understood in the following description of the present invention that an improved conveyor arranged as disclosed will overcome the now-inherent problems in existing conveyor systems used for this purpose.

OBJECTS AND SUMMARY OF THE INVENTION

The present invention has for an important object to prevent the breakdown problem that exists in present known conveyor systems by providing a conveyor system that will first move only half of a load—that portion of the load adjacent the rear or discharge end of the cargo box of a tractor-trailer unit—the second half of the load being discharged as the cleated quarter section of the conveyor system engages the forward load and then, without undue strain, is capable of moving the remaining half of the load along the length of the cargo box. Thus, the total load of refuse material is extracted in two separate loads, rather than in one load, as is now the method.

It is another object of the invention is to provide a conveyor system of this type wherein the cleats are positioned on only a quarter of the portion of the continuous conveyor chain, the cleats being positioned adjacent the rear or discharge end when the cargo area is loaded.

It is another object of the invention to provide a conveyor system of this type that can operate continuously, with less conveyor chains than are usually employed.

It is still another object of the invention to provide a conveyor system that will not only handle refuse, but that is suitable for use with most bulk-type materials that are too heavy for handling by the average rear-discharge tractor-trailer vehicle.

It is a further object of the invention to provide a continuous-conveyor unit that is easy to operate, service and maintain, yet is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 comprises a cross-sectional view of a tractor trailer unit, showing a continuous conveyor system disposed throughout the full length of the floor of the trailer;

FIG. 2 is a top-plan view thereof to show the general location of the conveyor cleats located adjacent the rear half or discharge end of the trailer;

FIG. 3 is a top-plan view of a fragment of one of the cleat sections attached to one of the conveyor chains;

FIG. 4 is an enlarged cross-sectional view of a conveyor cleat taken substantially along line 4—4 of FIG. 3; and FIG. 5 is a broken-away perspective view of a conveyor cleat.

DESCRIPTION OF THE PREFERRED EMBODIMENT

Referring now with more particularity to the drawings, wherein like reference characters designate like or corresponding parts throughout the various views, there is shown in FIGS. 1 and and 2 a tractor-trailer vehicle, generally indicated at 10. The tractor-trailer 10 is defined as a cargo box 11 having longitudinal side walls 12 and 14; a forward or front wall 16; and a rear-discharge end gate 18. End gate 18 includes means for allowing said gate to be opened, thereby permitting material stored in cargo box 11 to be discharged therefrom, the gate having suitable hinge means 20. Cargo box 11 further includes a floor or bed 22 which extends from the front wall 16 to the rear gate 18.

The cargo area within the box structure 11 is normally filled from the top which is generally open. However, when material such as refuse is dumped in bulk form into box 11, a cover is then placed and secured over the opening to assure that the contents are confined therein.

It should be noted that the refuse, including rubbish of all kinds, is compacted as much as possible. However, the contents have a tendency to expand and frictionally bind to the side walls 12 and 14 of the cargo box. Because of this friction problem and the weight of the material, operational problems are created.

However, to overcome such problems as previously mentioned herein, the present conveyor system, designated at 24, is provided with and comprises at least one—but preferably a pair of—continuous conveyor belt, formed as chains 26 and 28 which extend longitudinally above and below the floor or vehicle bed 22. The chains are placed in parallel relationship to each other and are operably mounted to drive means 30. Drive means 30 comprises a motor drive 32, of any suitable type, adapted to drive a transverse axle 34 having a pair of drive sprockets 36 located at the rear of the cargo box 11. The forward end of the floor 22 is provided with a second transverse axle 38 and sprockets 40. Thus, the chain is permitted to travel in either direction—that is, forwardly (indicated by arrow 42) and rearwardly (indicated by arrow 44). However, the rearward direction is the normal direction for discharging the contained materials out of the rear when gate 18 is opened.

Now, it is important to note that each chain 26 and 28 are provided with material-engaging means defined by a plurality of cleat members 45, along with a forward group of interlocked cleats 46. Cleat members 45 and cleat groups 46 are secured to their respective chains along only one quarter of the overall continuous length of each chain. Thus, as seen in FIGS. 1 and 2, the cleats are positioned above the rear-half portion of floor 22.

Accordingly, because the cleats are attached to only one quarter of the complete length of the chains, only one half of the total surface area of the floor can be covered with the cleats at one time.

Cleat pairs 45 are arranged oppositely to each other—that is, cleats **45*a* are secured to one side of chains 26 and 28, and cleats 45*b* are secured to the opposite side thereof—each cleat being provided with a linking bar 48 which acts as a link within the chain structure. However, due to the various arrangements and designs of known chain belts, it is contemplated that the cleats 45 might be affixed to the chain in a manner offset to each other. The cross-sectional view of FIG. 4 illustrates the linking bar 48 being secured to cleat 45*b* by welding, and cross-sectionally formed having a substantially "L"-shaped configuration. Thus, the cleats on chain 26 are aligned transversely with respective cleats on chain 28, whereby the width of floor 22 is transversed so as to engage the material displaced between walls 12 and 14**.

Referring to FIG. 5, there is illustrated a cleat **46*a* which is the arrangement of the cleats as shown in cleat groups 46. Each cleat of the groups is provided with a substantially "L"-shaped configuration similar to cleats 45. However, cleats 46*a* include two oppositely disposed link members 50, whereby one link is secured to a chain and forms a part of the chain as a link, seen in FIG. 3. The opposite free link is connected to a short length of chain 51, established by links 50 and 53, thereby interconnecting a plurality of cleats to define groups 46. The arrangement of interconnecting links allows the group of cleats to be operably when passing about sprockets 36 and 40**.

In FIG. 1, there is shown refuse material 52 loaded within the defined cargo-box area 11 having the fully compacted contents distributed over the entire length of the conveyor chains 26 and 28, and floor 22. Hence, if cleats were provided continuously throughout the length of the chains as is normally done, the conveyor system must then be capable of moving the full load at one time.

However, it can be readily understood that, when only one-half of the upper portion of chains 26 and 28 is provided with cleats, only the rear or aft half of the contents will be moved rearwardly for discharging. Seventy-five percent of the free chain length does not engage the contents, and thus does not affect the movement thereof.

As the cleats return to the upper forward end of the cargo box, the rearward half of the contents has been discharged and the cleats will engage the second forward half of the contents. At this time, the remaining contents are moved rearwardly for discharging. Only half of the total load and force of the contents 52 is applied to the overall conveyor system.

It is further contemplated that additional continuous chain belts, such as 26 and 28, can be provided and secured to the cleats in place of the short interconnecting chains in groups 46, when a particular type of contents requires such an arrangement.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, escept as defined in the accompanying claims.

I claim:

1. An improved conveyor system adapted for use with a cargo-trailer-type vehicle defining a cargo box having side walls, and a floor extending longitudinally between a front wall and a rear-discharge end, whereby the stored contents therein are discharged therefrom in half loads, said conveyor system comprising:

a movable conveyor means extended about the floor of said cargo box in a continuous manner, said movable conveyor means comprising at least one pair of endless chain belts arranged in a spaced, longitudinal, parallel relationship to each other;

means operably connected to said conveyor means to move said conveyor means about said floor in a continuous manner; and means for engaging said contents, wherein said engaging means comprises a plurality of cleat members affixed to said chains, said cleats being arranged to be disposed transversely across the width of said floor and positioned along one quarter of the length of each endless chain, and positioned adjacent the rear half of said cargo box when said contents are loaded in said cargo box, whereby the rear half of the contents is moved rearwardly for discharging prior to the forward half of the load being moved rearwardly for discharging.

2. An improved conveyor system as recited in claim 1, wherein a first plurality of cleat members are interlinked to themselves and to said chain to define a forward-engaging group of cleats, and wherein a second plurality of individual cleat members are spaced apart along said chain and interlinked to said chain.

3. An improved conveyor system as recited in claim 2, wherein said cleat members are oppositely disposed to each other in pairs along said chain, a pair of cleats of one chain being transversely aligned with a respective pair of cleats of another chain.

4. An improved conveyor system as recited in claim 1, wherein said means for moving said conveyor comprises:

a forward axle positioned along the forward portion of said floor;

a rearward axle positioned along the discharge end thereof;

sprocket members mounted to said axles to engage said chain belts; and a motor drive operably connected to at least one of said axles.

5. A method of discharging bulk contents from a trailer type cargo box, said method comprising the steps of:

providing a pair of endless chain belts for movement about the floor of said cargo box;

attaching a plurality of cleat members to said endless chain belts;

locating said cleat members on only one-quarter of the total length of said endless chain, whereby the cleat members traverse only one-half the length of said floor at any given time; and positioning said cleat members to cover the rear half of said floor prior to loading said bulk contents in said cargo box, whereby the rear half of said contents is discharged first and the remaining half of the contents is discharged thereafter.

* * * * *